US011262145B2

(12) United States Patent
Brumfield et al.

(10) Patent No.: US 11,262,145 B2
(45) Date of Patent: Mar. 1, 2022

(54) METHOD AND APPARATUS FOR CLEANING TUBES IN A ROTARY PATH

(71) Applicant: Peinemann Equipment B.V., Hoogvliet (NL)

(72) Inventors: Michael K. Brumfield, Spring, TX (US); Kristen E. Gromes, Navarre, OH (US)

(73) Assignee: PEINEMANN EQUIPMENT B.V.

( * ) Notice: Subject to any disclaimer, the term of this patent is extended or adjusted under 35 U.S.C. 154(b) by 66 days.

(21) Appl. No.: 16/526,355

(22) Filed: Jul. 30, 2019

(65) Prior Publication Data

US 2019/0353436 A1 Nov. 21, 2019

Related U.S. Application Data

(63) Continuation of application No. 15/585,637, filed on May 3, 2017, now Pat. No. 10,502,509.

(60) Provisional application No. 62/331,001, filed on May 3, 2016.

(51) Int. Cl.

| | |
|---|---|
| ***B05B 15/68*** | (2018.01) |
| ***B08B 9/032*** | (2006.01) |
| ***B08B 9/043*** | (2006.01) |
| ***F28G 1/16*** | (2006.01) |
| ***F28G 15/00*** | (2006.01) |

(Continued)

(52) U.S. Cl.

CPC ..... *F28G 1/163* (2013.01); *B05B 15/68* (2018.02); *B08B 9/0321* (2013.01); *B08B 9/0433* (2013.01); *F28G 15/003* (2013.01); *F28G 15/02* (2013.01); *F28G 15/04* (2013.01)

(58) Field of Classification Search

None

See application file for complete search history.

(56) References Cited

U.S. PATENT DOCUMENTS

| | | | |
|---|---|---|---|
| 3,794,051 | A | 2/1974 | Lee et al. |
| 3,821,498 | A | 6/1974 | Shaefer, Jr. et al. |
| 3,901,252 | A | 8/1975 | Riebe |

(Continued)

FOREIGN PATENT DOCUMENTS

| | | | |
|---|---|---|---|
| CN | 100500308 | C | 6/2009 |
| CN | 203250208 | U | 10/2013 |

(Continued)

OTHER PUBLICATIONS

Operation Manual Sabertooth Air Powered Dual Hose Reel StoneAge. 2010.

(Continued)

*Primary Examiner* — Levon J Shahinian

(74) *Attorney, Agent, or Firm* — Sand, Sebolt & Wernow Co., LPA

(57) ABSTRACT

A heat exchanger cleaning device is provided. The cleaning device includes a drive motor configured to rotate a gearbox, a slip clutch, and a support beam about a first axis. The support beam carries a thread rod, a second motor, and one or more carriage assemblies. The carriage assemblies move linearly as the second motor rotates the threaded rod. The carriage assemblies include a support tube for receiving an ultra-high pressure tube therethrough. The carriage assemblies adjust relative to the heat exchanger such that the UHP tube may be inserted through the support tube into a hole of the heat exchanger. Therein the UHP tube may be advanced to clean sediment from the heat exchanger tube.

20 Claims, 7 Drawing Sheets

(51) Int. Cl.
*F28G 15/02* (2006.01)
*F28G 15/04* (2006.01)

(56) References Cited

U.S. PATENT DOCUMENTS

| | | | |
|---|---|---|---|
| 3,903,912 | A | 9/1975 | Ice et al. |
| 4,001,556 | A | 1/1977 | Folchi et al. |
| 4,229,136 | A | 10/1980 | Panissidi |
| 4,367,790 | A | 1/1983 | Draeger |
| 4,437,201 | A | 3/1984 | Zalewski |
| 4,527,515 | A | 7/1985 | Hester |
| 4,716,611 | A | 1/1988 | Barry |
| 4,773,357 | A | 9/1988 | Scharton et al. |
| 5,570,660 | A | 11/1996 | Vandenberg |
| 5,838,882 | A | 11/1998 | Gan et al. |
| 6,681,839 | B1 | 1/2004 | Balzer |
| 8,057,607 | B2 | 11/2011 | Gardner et al. |
| 8,308,869 | B2 | 11/2012 | Gardner |
| 8,524,011 | B2 | 9/2013 | Gardner |
| 8,646,416 | B2 | 2/2014 | Hawkins et al. |
| 10,514,217 | B2 | 12/2019 | Wall et al. |
| 2004/0069331 | A1 | 4/2004 | Garman et al. |
| 2008/0185126 | A1 | 8/2008 | Jiang et al. |
| 2012/0024321 | A1 | 2/2012 | Hays |
| 2012/0067370 | A1 | 3/2012 | Crock et al. |
| 2015/0034128 | A1 | 2/2015 | Brumfield |
| 2015/0068563 | A1 | 5/2015 | Gzym et al. |
| 2015/0258694 | A1 | 9/2015 | Hand et al. |
| 2016/0025433 | A1 | 1/2016 | Mathis |
| 2016/0243597 | A1 | 8/2016 | Shawver |
| 2017/0102195 | A1 | 4/2017 | Watkins |
| 2017/0108300 | A1 | 4/2017 | Brumfield |
| 2017/0348931 | A1 | 12/2017 | Yuzer et al. |
| 2018/0281030 | A1 | 10/2018 | Eisermann et al. |

FOREIGN PATENT DOCUMENTS

| | | | |
|---|---|---|---|
| CN | 203837569 | U | 9/2014 |
| CN | 104181867 | A | 12/2014 |
| CN | 104440896 | | 3/2015 |
| DE | 102014104356 | | 10/2015 |
| EP | 0569080 | | 11/1993 |
| EP | 0803697 | | 10/1997 |
| FR | 2563331 | | 10/1985 |
| WO | 0111303 | | 2/2001 |
| WO | 2016037197 | | 3/2016 |

OTHER PUBLICATIONS

Spong, et al. Robot Dynamics and Control. 2nd Edition p. 9,1.1, pp. 13-22, 1.3.1-1.3.6; Jan. 28, 2004.

Shawver. How Automated Water Jetting Improves Tube Bundle Cleaning Efficiency. 2011 WJTA-IMCA Conference and Expo. Sep. 2011. Houston, TX.

Video Stutes Enterprise Live Demo—2013 WJTA-IMCA Conference & Expo (https://www.youtube.com/watch?v=zoCFoopM yU).

Video Peinemann Equipment Live Demo—2013 WJTA-IMCA Conference & Expo Sep. 11, 2013 (https://www.youtube.com/watch ?v=GPa2w65ZNkE).

Video Veolia Diamondback(https://www.youtube.com/watch?v=8tAZwctqneQ); Feb. 13, 2014.

TI-HD-3A Indexing System, Indexer Designed for Confined Entry Positioning, pp. 1-2, Feb. 2016, Terydon Incorporated, Ohio.

Want Smart Indexing in Confined Entry Tube Cleaning, https://youtube.com/watch?v=P3xBOPKMfCY, pp. 1-14 (screenshots), Oct. 11, 2016.

Operation Manual Sabertooth Air Powered Dual Hose Reel StoneAge, StoneAge Waterblast Tools, (Sep. 1, 2010), pp. 1-7, XP055762268.

METHOD AND APPARATUS FOR CLEANING TUBES IN A ROTARY PATH

CROSS REFERENCE TO RELATED APPLICATIONS

This application is a Continuation of U.S. patent application Ser. No. 15/585,637 filed May 3, 2017, which claims the benefit of prior co-pending U.S. Provisional Patent Application Ser. No. 62/331,001, filed on May 3, 2016; the entire disclosures of which are entirely incorporated herein by reference.

BACKGROUND

Technical Field

The present disclosure relates generally to heat exchanger cleaning devices. More particularly, the present disclosure relates to cleaning devices utilizing at least one ultra-high pressure hose that is inserted into heat exchanger tubes to clean sediment buildup. More particularly, the present disclosure relates to a method of cleaning heat exchanger tubes with a rotary apparatus.

Background Information

Cleaning heat exchangers is a difficult process and it must be done frequently as sediment buildup in heat exchangers is detrimental to their operation. Many heat exchangers include a plurality of longitudinally extending heat exchanging tubes where some of the sediment may build up.

Current heat exchanger cleaning devices utilize an ultra-high pressure hose wound around a cylinder and an indexer traveling along a two-dimensional grid in a linear way such that the indexer can move in an x-axis and a y-axis.

These heat exchanger cleaning devices continue to have problems, namely, their reliance on a two-dimensional x/y axis can leave some regions of the heat exchanger uncleaned when the heat exchanger is in a cylindrical form as many heat exchangers are configured.

SUMMARY

The issues that continue to exist and the deficiencies of conventional heat exchanger cleaning devices are addressed by the present disclosure.

In one aspect, the present disclosure may provide a heat exchanger cleaning device comprising: a gear box driven by a first motor, wherein the first motor rotates the gearbox about a first axis; a longitudinally extending support beam; a slip clutch intermediate the gear box and the support beam; a threaded rod carried by the support beam; a second motor carried by the support beam, wherein the second motor rotates the threaded rod; a carriage assembly carried by the support beam and operatively connected to the threaded rod. This device may also include a support tube carried by the carriage assembly, wherein the support tube is adapted to receive an ultra-high pressure (UHP) tube therethrough.

In another aspect, the present disclosure may provide a method of cleaning a heat exchanger comprising the steps of: attaching a rotary indexing device to a heat exchanger; rotating a linear support beam about a first axis; rotating a threaded rod carried by the support beam about a second axis perpendicular to the first axis; transitioning a carriage assembly linearly from a first position to a second position; aligning a portion of the carriage assembly with a hole formed in the heat exchanger.

In another aspect, the present disclosure may provide a heat exchanger cleaning device. The cleaning device includes a drive motor configured to rotate a gearbox, a slip clutch, and a support beam about a first axis. The support beam carries a threaded rod, a second motor, and one or more carriage assemblies. The carriage assemblies move linearly as the second motor rotates the threaded rod. The carriage assemblies include a support tube for receiving an ultra-high pressure tube therethrough. The carriage assemblies adjust relative to the heat exchanger such that the UHP tube may be inserted through the support tube into a hole of the heat exchanger. Therein the UHP tube may be advanced to clean sediment from the heat exchanger tube.

In yet another aspect, an embodiment of the present disclosure may provide a cleaning device comprising: a central first axis; a gear driven by a first motor; a support beam operatively connected to the gear so as to be rotatable about the central first axis in response to the first motor driving the gear; and a first carriage assembly carried by the support beam adapted to be positioned above holes formed in an end plate of a heat exchanger or other device forming a plurality of pipes or tubes that periodically need to be cleaned.

In yet another aspect, an embodiment of the present disclosure may provide a cleaning device comprising: a gear driven by a first motor; a central first axis; a support beam operatively connected to the gear so as to be rotatable about the central first axis in response to the first motor driving the gear; a slip clutch intermediate the gear and the support beam adapted to slip when an overload of torque occurs to protect components of a drive train; a first carriage assembly carried by the support beam adapted to be positioned above holes formed in an end plate of a heat exchanger or other device forming a plurality of tubes that periodically need to be cleaned. This embodiment or another may further provide an umbilical tube carried by the first carriage assembly receiving high pressure fluid therethrough and aligned with the holes formed in the end plate for cleaning pipes or tubes within the heat exchanger. This embodiment or another may further provide a second motor carried by the support beam; a screw carried by the support beam; wherein the second motor rotates the screw and the first carriage assembly moves longitudinally along a length of the screw and the support beam in response to movement of the second motor. This embodiment or another may further provide a controller configured to direct the first motor to rotate the support beam around the first axis and align a portion of the first carriage assembly above one of the holes. This embodiment or another may further provide a screw housed within the support beam and rotatable about a second axis perpendicularly intersecting the first axis; a first end opposite a second end of the screw and a midline of the screw aligned along the first axis; a first thread pattern associated with the first end of the screw and an equal but opposite second thread pattern associated with the second end of the screw. This embodiment or another may further provide wherein the slip clutch is in the form of an assembly including a sprocket sandwiched by pressure plates and a bushing extending therethrough. This embodiment or another may further provide wherein the slip clutch is a spring loaded friction style torque overload device adapted to slip in response to an overload torque in excess of a set torque level to prevent overloads from transmitting through other portions of a drive train and when the torque load falls below the set torque level, the slip clutch stops slipping and transmits the torque. This embodiment or another may further provide wherein the slip clutch does not maintain phase between input and output. This embodiment or another may further provide a second motor offset from the support beam configured to drive the screw via a chain and sprocket assembly; a drive axis of the second motor parallel to a second axis about which the screw rotates; wherein the second axis and drive axis are perpendicular to the first axis. This embodiment or another may further provide an extension arm on the first carriage assembly extendable in a direction perpendicular to a longitudinal direction of the support beam. This embodiment or another may further provide a guide tube carried by the extension arm, wherein the guide tube is moveable in response to extension and retraction of the extension and in response to rotation of the screw effecting linear movement of the first carriage assembly. This embodiment or another may further provide wherein the first carriage assembly is moveable between a narrowed first positioned and an outward second position.

In yet another aspect, an embodiment of the present disclosure may provide a method of cleaning a heat exchanger comprising: rotating a support beam carrying a first carriage assembly about a first axis extending parallel to cylindrical bores defined by a heat exchanger; rotating a screw carried by the support beam about a second axis perpendicular to the first axis; and moving, linearly, the first carriage assembly along the support beam in response to rotation of the screw. This embodiment or another may further provide aligning a guide tube carried by the first carriage assembly with at least one hole formed in an end wall of the heat exchanger in open communication with one of the cylindrical bores. This embodiment or another may further provide inserting an ultra-high pressure hose through the guide tube and into one of the cylindrical bores. This embodiment or another may further provide wherein aligning the guide tube is accomplished by positioning logic implemented by one or more processors implementing a set of instructions stored in a non-transitory computer readable storage medium. This embodiment or another may further provide extending an arm on the first carriage assembly in a direction perpendicular to a longitudinal axis of the support beam. This embodiment or another may further provide wherein rotation of the support beam is exterior to an end wall of the heat exchanger. This embodiment or another may further provide wherein rotating the screw is accomplished by a second motor and sprocket assembly in operative communication with the screw.

In another aspect, an embodiment of the present disclosure may provide a system comprising: a heat exchanger defining a plurality of cylindrical bores adapted to assist an exchange of heat between a first temperature and a second temperature, and an end wall of the heat exchanger defining a plurality of holes in open communication with the cylindrical bores; a rotatable cleaning device mounted proximate the end wall that is rotatable about an axis parallel to the plurality of cylindrical bores; and a high pressure hose carried by the rotatable device for passing therethrough into the cylindrical bores to clean an inner surface of the heat exchanger.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
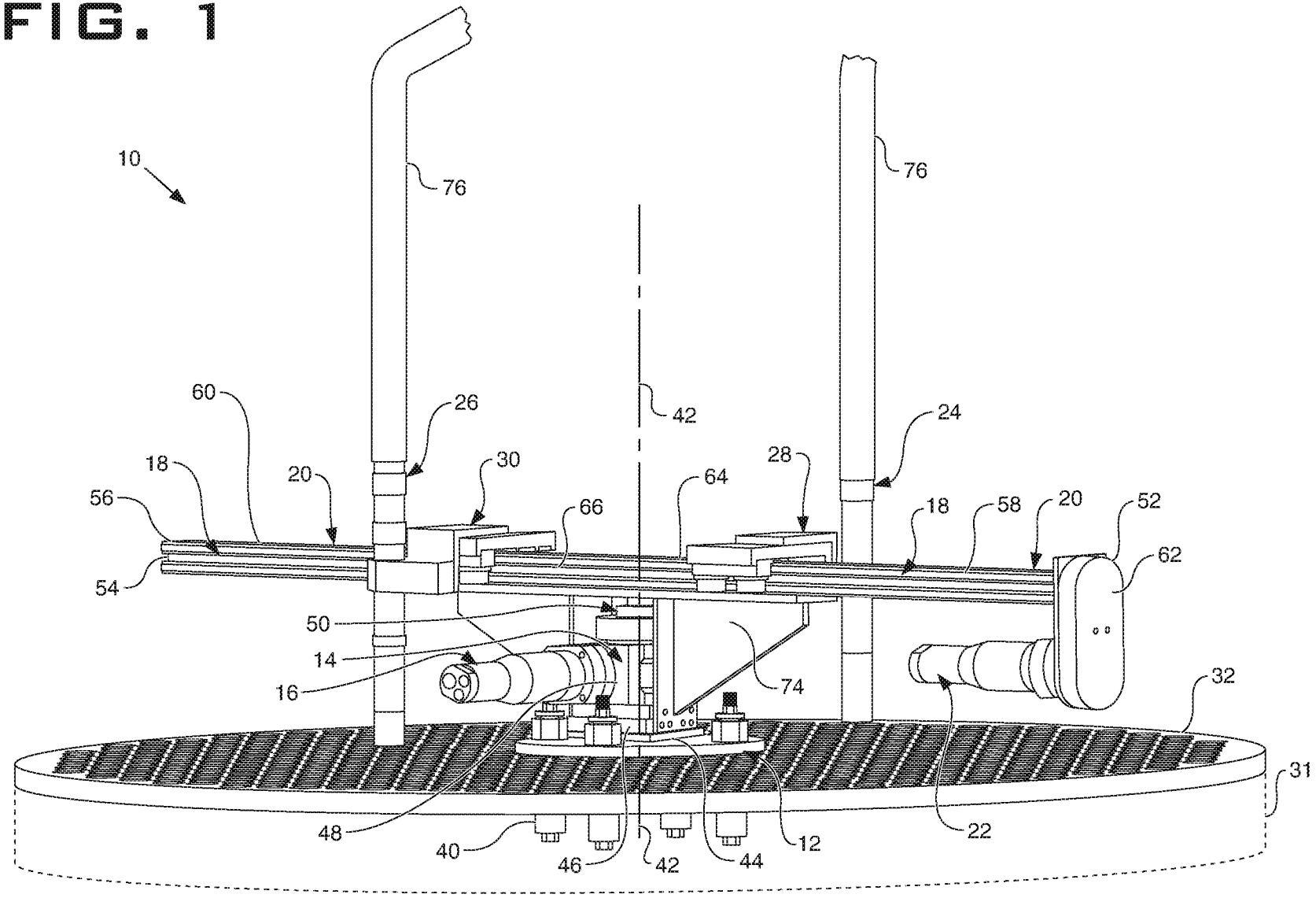
FIG. 1 (FIG. 1) is a perspective view of a rotary indexer apparatus for cleaning heat exchanging tubes in a rotary path.

As depicted throughout the figures, a rotary indexer in accordance with the present disclosure is generally indicated at 10 (sometimes also referred to as system 10). Rotary indexer 10 may include a base plate 12, a rotary gear assembly 14, a drive motor 16, a support beam 18, a two-way threaded rod or drive screw 20, a second motor 22, a first guide tube 24, a second guide tube 26, a first carriage assembly 28, and a second carriage assembly 30.

Base 12 is a generally rigid metal plate. In one particular embodiment, base 12 is circular in shape having an upwardly facing top surface and a downwardly facing bottom surface. Base 12 forms a plurality of apertures extending vertically through the plate from the upwardly facing top surface to the downwardly facing bottom surface. Base 12 is positioned above a circular end plate 32 of a heat exchanger 31. Base 12 is connected to circular end plate 32 and in one particular embodiment a plurality of bolts 40 is utilized to attach base 12 to end plate 32. However, other manners of connecting base 12 to end plate 32 are entirely possible, such as welding, or other mechanical manners, or other chemical manners, or other non-mechanical and non-chemical connecting manners or methods.

Base 12 defines a thickness of the plate from the top surface to the bottom surface that may be in a range from about ½ inch to about 4 inches. In one particular example, the thickness of the base plate 12 is less than a vertical thickness of the end plate 32 on the heat exchanger 31. In another particular example, the thickness of base 12 is similar to the thickness of end plate 32.

Circular end plate 32 defines a plurality of through holes 34 therein. Holes 34 may be formed in a symmetric pattern relative to a number of indexing axes 38 (FIG. 2) which intersects a central vertical axis 42. However it is to be understood that alternative pattern arrangements, such as asymmetric or random patterns are entirely possible as well.

Rotary gear assembly 14 is centered about a center vertical axis 42 and configured to rotate around axis 42. Rotary gear assembly 14 may include a bearing 44 having an axis of rotation that is coaxial with vertical axis 42 such that bearing 44 is considered concentric with axis 42. The bearing 44 may be positioned above the upwardly facing top surface of base 12 and near a bearing plate 46 configured to a support gear box 48. Gear box 48 is operably connected to drive motor 16. Gear box 48 may be a substantially rigid housing having a transverse width that is less than the diameter of the base plate 12. However, gear box 48 may be sized differently in other embodiments.

A slip clutch 50 is operably connected to gear box 48 enabling drive motor 16 and bearing plate 46 to rotate about vertical center axis 42 when powered by drive motor 16. Slip clutch 50 is a clutch that is designed to slip when an overload of torque occurs, thus protecting a reducer as well as other components in a drive train of the system 10. One exemplary advantage of slip clutch 50 is that it should prevent or reduce the likelihood of damage to drive components of system 10 or to a drive train of system 10. Once the overload or stress is cleared, slip clutch 50 automatically picks up the load and remains driving to rotate beam 18. Slip clutch 50 automatically resets itself after overload periods. Slip clutch 50 may sometimes also be referred to as a toque limiter or an overload clutch. In one example, slip clutch 50 may have a ¾", ⅞", 1", or 1-¼" bore with standard keyway and setscrews, however other size bores are entirely possible as well.

In one embodiment, when an overload occurs, the driven member slips between long life-clutch type friction plates. Slip clutch 50 may be in the form of an assembly including a sprocket sandwiched by pressure plates and a bushing extending therethrough. One exemplary slip clutch 50 utilized in accordance with an aspect of the present embodiment is commercially available for sale under the trademark TORQUE-TAMER by Baldor Electric Company of Fort Smith, Ark.

In another example, slip clutch 50 is a spring loaded friction style torque overload device. The load on the friction pads is adjusted so that the process torque is transmitted. An overload torque in excess of the set torque causes the slip clutch to slip. This prevents overloads from transmitting through the system. When the load falls below the set level, the torque limiter stops slipping and transmits the torque. In one example, a torque limiter does not maintain phase between input and output.

Other types of slip clutches are possible for slip clutch 50. For example, slip clutch 50 may be friction plate, which is similar to a friction plate clutch in that over-torque will cause the plates to slip. Alternatively, slip clutch 50 may be a magnetic particle in which a torque setting fairly approximates a linear relationship with the current passing through the windings, which can be statically or dynamically set depending on needs. Alternatively, slip clutch 50 may be of a magnetic hysteresis type which may be non-synchronous in normal operation.

Support beam 18 includes a first end 52 spaced opposite a second end 54. Beam 18 is a generally elongated rigid member extending between first end 52 and second end 54. Beam 18 further defines a longitudinally extending central bore 56 wherein a two-way threaded drive screw 20 is positioned within the longitudinally extending central bore 56. Beam 18 further defines two C-shaped channels along the sidewalls of beam 18. In one particular embodiment, a first C-shaped channel 58 is positioned on one side of beam 18 and a second C-shaped channel 60 is positioned on a second side of beam 18 opposite that of first C-shaped channel 58. In one example, the beam 18 is an extruded piece of elongated metal, such as an aluminum or other alloy which defines the central bore 56 and the first and second C-shaped channels 58, 60.

Longitudinally extending central bore 56 is sized to have a width and depth greater than that of drive screw 20. In one embodiment, drive screw 20 extends entirely the length of beam 18 from second end 54 towards first end 52. However, other versions may have a screw 20 that is slightly longer or slightly shorter than the central bore 56. The screw 20 includes threads. A screw thread, often shortened to thread, is a helical structure used to convert between rotational and linear movement or force. A screw thread is a ridge wrapped around a cylinder or cone in the form of a helix, with the former being called a straight thread and the latter called a tapered thread. The screw threads may be unidirectional along the entire length of the screw 20, or the screw threads may be opposingly threaded (i.e., threaded in opposite directions) relative to the midpoint of the screw 20. Stated otherwise, the threads of screw 20 near the first end may be clockwise threaded and the threads of screw 20 near the second end may be counter-clockwise threaded. The longitudinal midpoint of screw 20 is coplanar with vertical axis 42. Furthermore, the midpoint of screw 20 is the point at which the screw 20 rotates about relative to the vertical axis 42, while simultaneously rotating about its longitudinal axis 21. Longitudinal axis 21 of screw 20 is perpendicular to vertical axis 42.

In one particular example, drive screw 20 includes two sections, namely, a first section 64 and a second section 66. First section 64 is entirely offset towards the first end 52 relative to central vertical axis 42 and second section 66 is entirely offset towards the second end 54 from vertical axis 42. First section 64 and second section 66 are each threaded; however, first section 64 is threaded in an opposite direction than the threads of second section 66. Although the threads on the respective sections 64, 66 are opposite, the pitch of each thread is identical.

Figure 4:
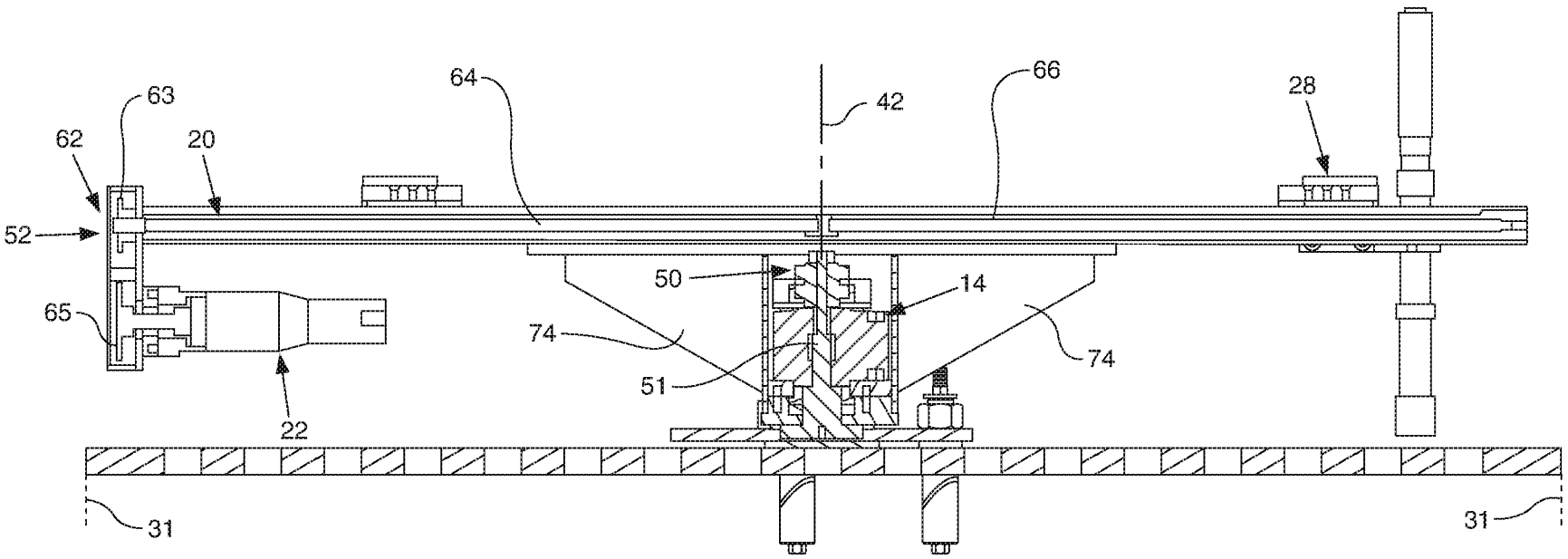
FIG. 4 (FIG. 4) is a longitudinal cross section taken through the center of the rotary indexer apparatus.

As depicted in FIG. 4, proximate first end 52, the second motor 22 is operably connected to drive screw 20 through a sprocket drive assembly 62. As will be described in further detail below, the rotation of screw 20 about its longitudinal axis 21 effectuates linear movement of the carriage assemblies which are operatively connected to the screw 20. Stated otherwise, the carriage assemblies may linearly move in response to rotational movement of screw 20.

Sprocket drive assembly 62 may include one sprocket 63 rigidly connected to drive screw 20 and a second sprocket 65 rigidly connected to second motor 22 and a chain extending therebetween the two sprockets such that when second motor 22 is activated to spin the second sprocket 65, the chain imparts rotational-to-rotational movement to drive screw 20 as will be described in greater detail below.

Figure 3:
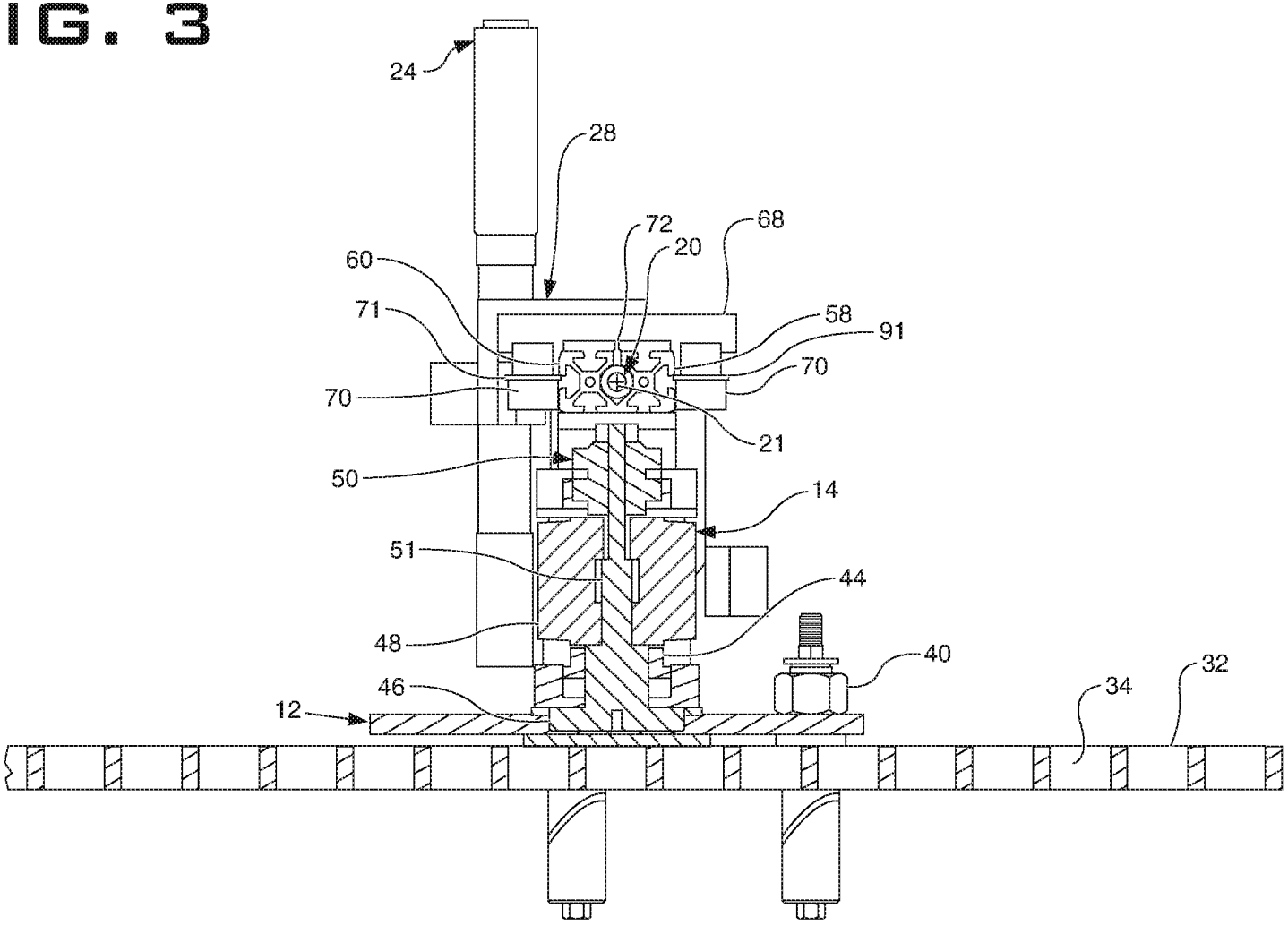
FIG. 3 (FIG. 3) is a transverse cross section taken through the center of the rotary indexer apparatus.

As depicted FIG. 3, when viewed in transverse cross-section, the first carriage assembly 28 is shown. Prior to discussing the components of first carriage assembly 28 it is to be understood that second carriage assembly 30 is similar to first carriage assembly 28 and includes similarly numbered parts. However, second carriage assembly 30 is primarily disposed on the opposite side of support beam 18 than first carriage assembly 28 and its similar components are not repeated herein for brevity but are to be understood and being structurally similar as identified by similar reference numerals.

With primary reference to the transverse cross-section, first carriage assembly 28 includes an L-shaped carriage frame 68 including a horizontal portion extending transversely above beam 18 and a vertical leg portion extending vertically parallel offset to beam 18 adjacent second channel 60. A pair of wheels 70 are supported by carriage frame 68. The wheels 70 may rotate about a vertically aligned axis which is offset parallel to the central vertical axis 42.

Wheels 70 may include a lip 71 on each wheel that extends into one of the first channel 58 and the second channel 60. In one embodiment, the lip 71 is associated with the upper portion of the wheel 70. However, the lip 71 may be located at other portions of the wheel, such as near the vertical midline or the bottom of the wheel 70.

A follower nut 72 is rigidly connected with frame 68 and may be positioned intermediate the pair of wheels 70 and be positioned directly above screw 20. In one embodiment, the follower nut 72 engages the threads of screw 20 such that rotational movement of the screw 20 imparts longitudinal linear movement along the length of the beam 18 to the carriage assembly 28. As the screw rotates about its longitudinal axis 21, the follower nut 72 affects movement and rotation of the wheels in the first and second channels 58, 60. While it is contemplated that wheels 70 are idler wheels, there may be some implementations where wheel 70 may be driven by a motor.

As depicted in FIG. 4, when viewed in longitudinal cross-section, a pair of support flanges 74 may extend vertically and outwardly from adjacent the gear box 48 towards the first end 52 and the second end 54, respectively. Support flanges 74 are fabricated from rigid members configured to support beam 18 from the beneath such that beam extends outwardly from one rigid member towards the first end 52 in a cantilevered manner and the rigid beam extends outwardly from another rigid support flange 74 towards second end 54 in a cantilevered manner relative to the central axis 42.

Figure 5A:
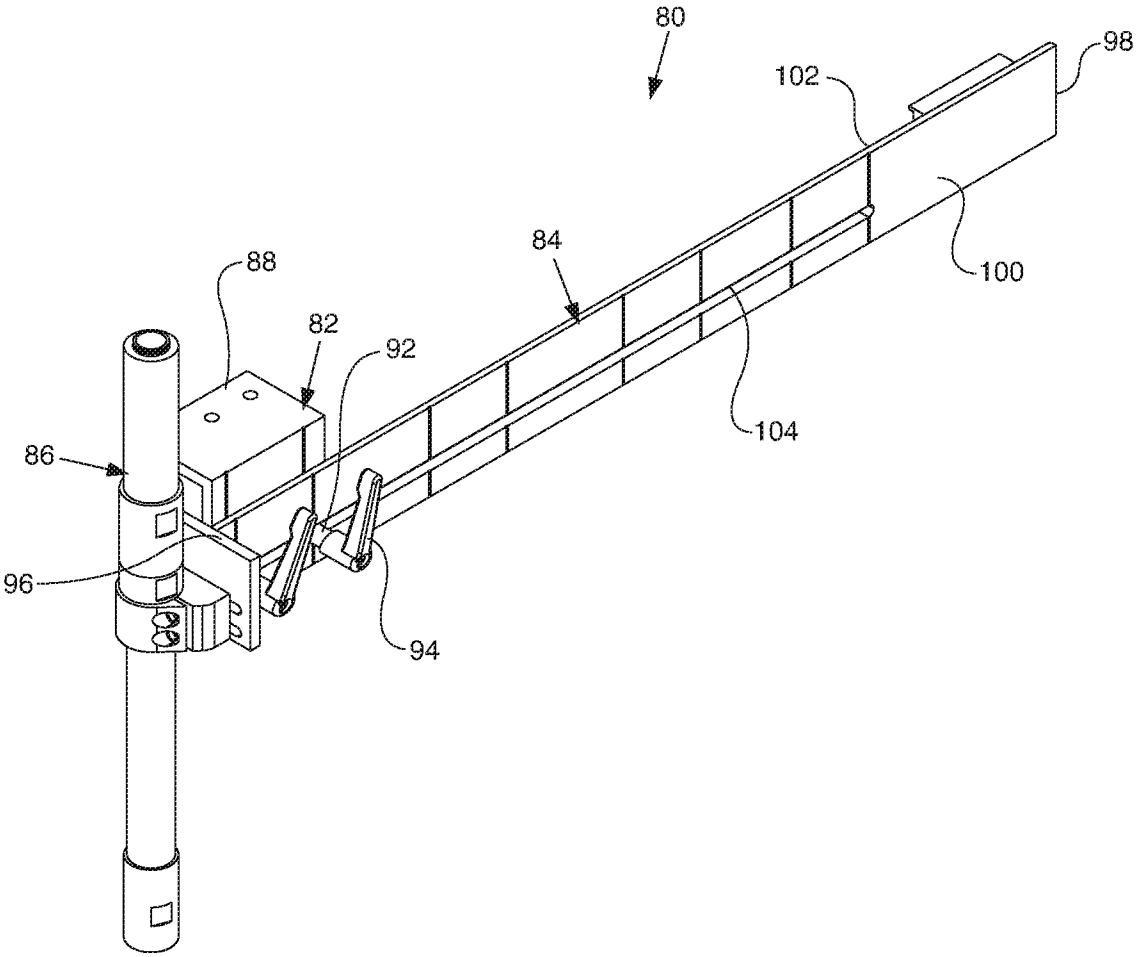
FIG. 5A (FIG. 5A) is a front isometric view depicting an extension arm which connects with a carriage assembly (not shown in FIG. 5A, rather shown in FIG. 1).
Figure 5B:
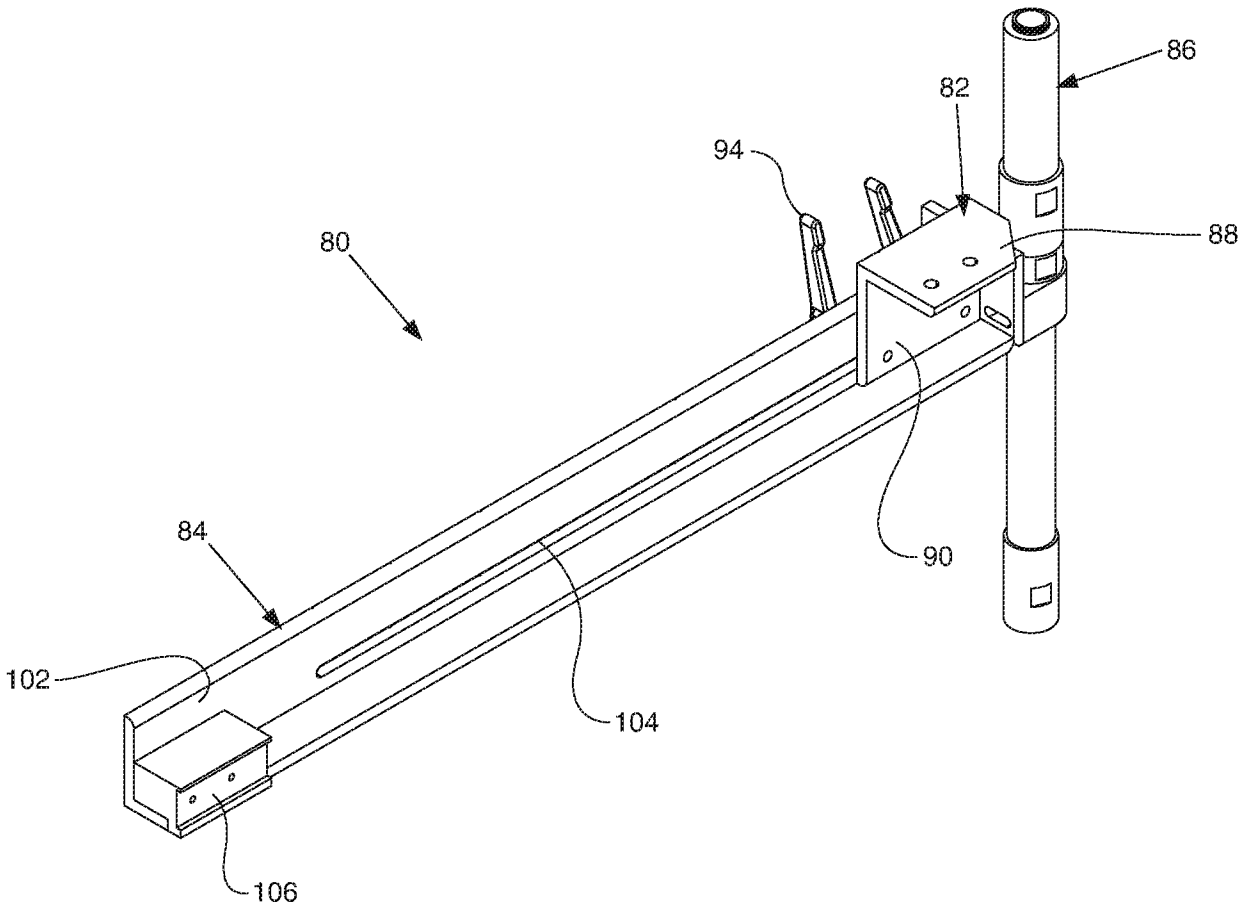
FIG. 5B (FIG. 5B) is a rear isometric view depicting the extension arm which connects with the carriage assembly (not shown in FIG. 5B, rather shown in FIG. 1).

As depicted in FIG. 5A and FIG. 5B, an alternative embodiment of the present disclosure may include an extension assembly 80 which may be connected to either or both of the first carriage assembly 28 and the second carriage assembly 30. Reference will be made to the extension assembly 80 connecting with the first carriage assembly 28, however it is to be understood that a second extension assembly would attach to the second carriage assembly 30 in a similar manner.

The extension assembly 80 includes a mounting bracket 82 and an extension arm 84 carrying a guide tube 86. The mounting bracket 82 is a substantially rigid member configured to support at least a portion of the weight of the extension assembly 80. Mounting bracket 82 defines at least one through hole for connecting bracket 82 with the first carriage assembly 28 via a screw (not shown). However, other manners of attaching mounting bracket 82 to the first carriage assembly 28 are entirely possible. In one example, mounting bracket 82 is an L-shaped bracket and the holes receiving the screws therethrough extend through the upper leg 88 of the L-shaped bracket. A lower leg 90 extends downwardly from upper leg 88. A plurality of pins or other extension members extend transversely outward and away from lower leg 90. In one example, the pins 92 are perpendicular to leg 90. The pins 92 are in operative communication with screw-down or tightening handles 94 which effectuate a locking relationship between the mounting bracket 82 and the extension arm 84.

Extension arm 82 is generally elongated, extending from a first end 96 to a second end 98. Extension arm 82 includes a first side 100 defining a first major surface and a second side 102 defining a second major surface. Extension arm 82 defines a longitudinally extending through-slot 104. The term through-slot refers to the slot extending entirely from the first side 100 to the second side 102. In one example, the guide tube 86 is rigidly connected proximate the first end 96 of extension arm 84.

The bracket 82 is offset from the extension arm 84 closely adjacent the second side 102. The pins 92 on bracket 82 extend through the through-slot 104 and the handles 94 are positioned closely adjacent first side 100 of arm 84. The bracket 82 is fixedly connected to carriage assembly 82, thus, when the tightening handles 94 are secured to pins 92, the extension arm 84 is releasably locked in place. The handles 94 may be loosened to allow extension arm 84 to move longitudinally along the length of the through-slot 104.

Figure 6:
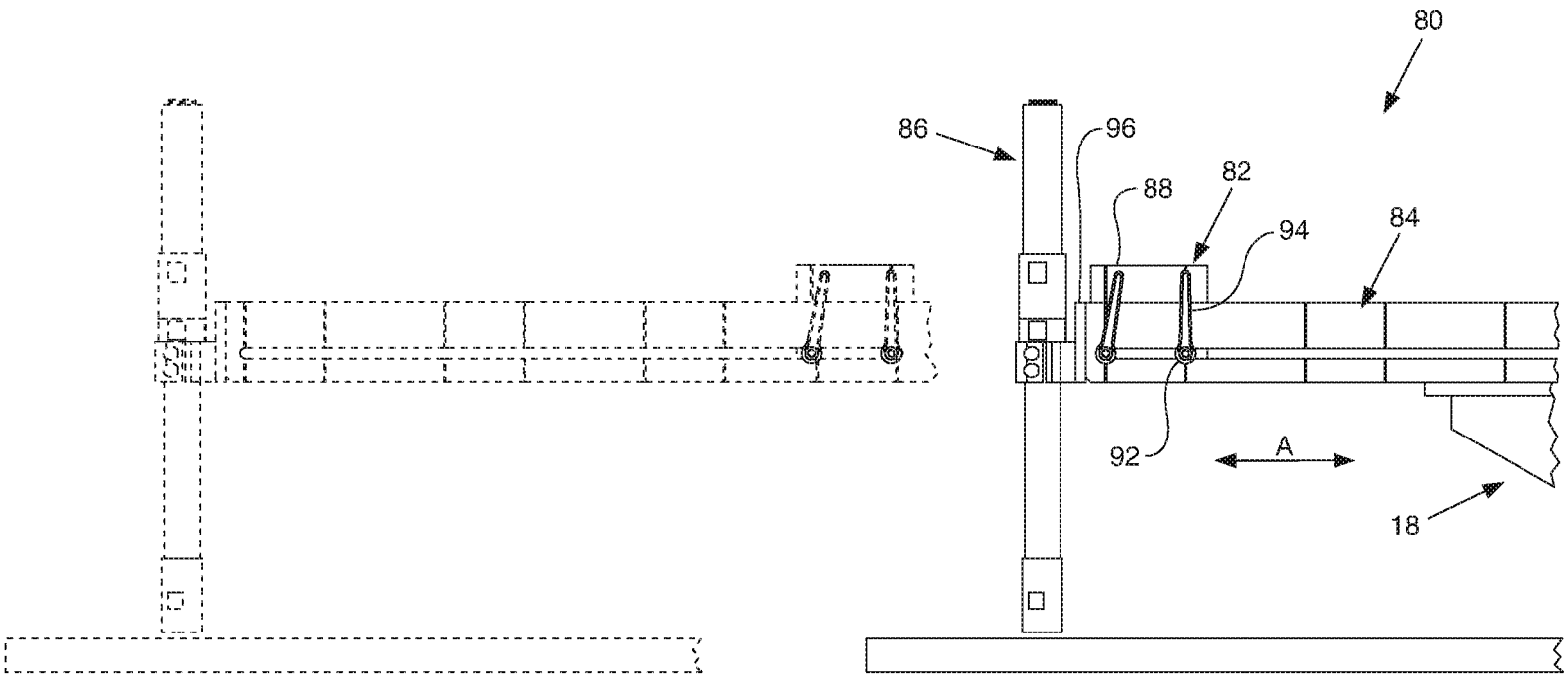
FIG. 6 (FIG. 6) is an operational side elevation view of the extension arm connected to the carriage depicting the ability to effectuate sliding movement to increase the diameter of the high pressure hoses for cleaning heat exchanger with diameters up to about 102 inches.

As depicted in FIG. 6 if guide tube 86 needs to have an increased or decreased diameter relative to first axis 42, then the handles 94 may be loosened and the extension arm 84 may be moved (either extended or shortened in the direction of Arrow A as the case may be) to a position having a different diameter. Thereafter, the handles may be releasably secured to lock the extension arm in this position with the different second diameter. The extension arm 84 is sized so as to allow the guide tube 86 (which carries an ultra-high pressure or high pressure hose) to clean cylindrical bores of a heat exchanger having a diameter in a range from about 60 inches to about 102 inches or more.

FIG. 6 more particularly depicts the extension arm 84 moving from a lesser first diameter to a greater second diameter. In this instance, the handles 94 are loosened. This allows the pins 92 attached to bracket 82 to act as guides for the slot 104 of the extension arm to move therealong as the extension arm 84 moves radially outward relative to axis 42. When in the desired greater second diameter, the handles 94 may lock the extension arm 84 in the greater second diameter.

A support block 106 may be positioned closely adjacent the second side 102 of the extension arm 84 near second end 98. The support block 106 may include a wheel or other member (not shown) configured to ride within the C-shaped channels of the support beam 18. This enables stability of the extension arm 84 as it is moved between varying diameters generally parallel to the longitudinal axis of support beam 18.

In accordance with an aspect of the present disclosure, the rotary indexer 10 provides a new and improved way to enable the cleaning of cylindrical heat exchangers comprising a plurality of tubes concentrically aligned with holes 34 in end plate 32. The rotary indexer allows the first and second guide tubes 24, 26 to move in unison along the length of beam 18. Alternatively, an embodiment may provide where the first and second guide tubes 24, 26 move independently along the length of beam 18, however, this may require an alternative drive mechanism other than screw 20.

Prior to cleaning the tubes (i.e., cylindrical bores) of a heat exchanger 31, the rotary indexer 10 must be attached to the end wall plate 32 of the heat exchanger 31. An installer aligns the apertures formed in the base 12 with corresponding connectors on the end plate 32. In one embodiment, the corresponding connectors on the end plate 32 may be threaded rods projecting outwardly from the end plate 32 configured to extend through the apertures in the base 12. In another embodiment, the corresponding connectors may be similarly sized apertures formed in end plate 32 and a plurality of bolts extend through the aligned apertures. In each scenario, the installer will tighten nuts associated with the screws or threaded rods to rigidly secure base 12 to end plate 32.

Once base 12 has been attached to end plate 32, a power source may be connected to the first and second motors 16, 22. In some implementations the two motors 16, 22 may be battery powered, however it is contemplated that A/C power is preferable.

In operation, rotary indexer 10 rotates about central axis 42 when drive motor 16 is electrically activated. Drive motor 16 is mounted to the gear box 48 and is operably coupled to drive shaft 51 within gear box 48 which is operably coupled to slip clutch 50.

Drive motor 16 imparts rotational movement to gears within gear box 48. The gears within gear assembly 14 impart rotational movement to drive shaft 51. The drive shaft 51 passes through slip clutch 50. In one embodiment, the slip clutch 50 utilizes friction pads to ensure that certain thresholds associated with the rotating drive shaft are not exceed. For example, the slip clutch may intentionally slip, thereby allowing the drive shaft 51 to free-spin, if the drive shaft torque exceeds a set threshold, or if the drive shaft revolutions per minute exceeds a set threshold.

The rotational movement of gears within gear box 14 and drive motor may move in unison to operatively impart rotational movement to support beam 18. Namely, slip clutch 50 is operatively connected intermediate the two ends of support beam 18. In one particular embodiment, slip clutch is connected at the mid-section of support beam 18.

Figure 2:
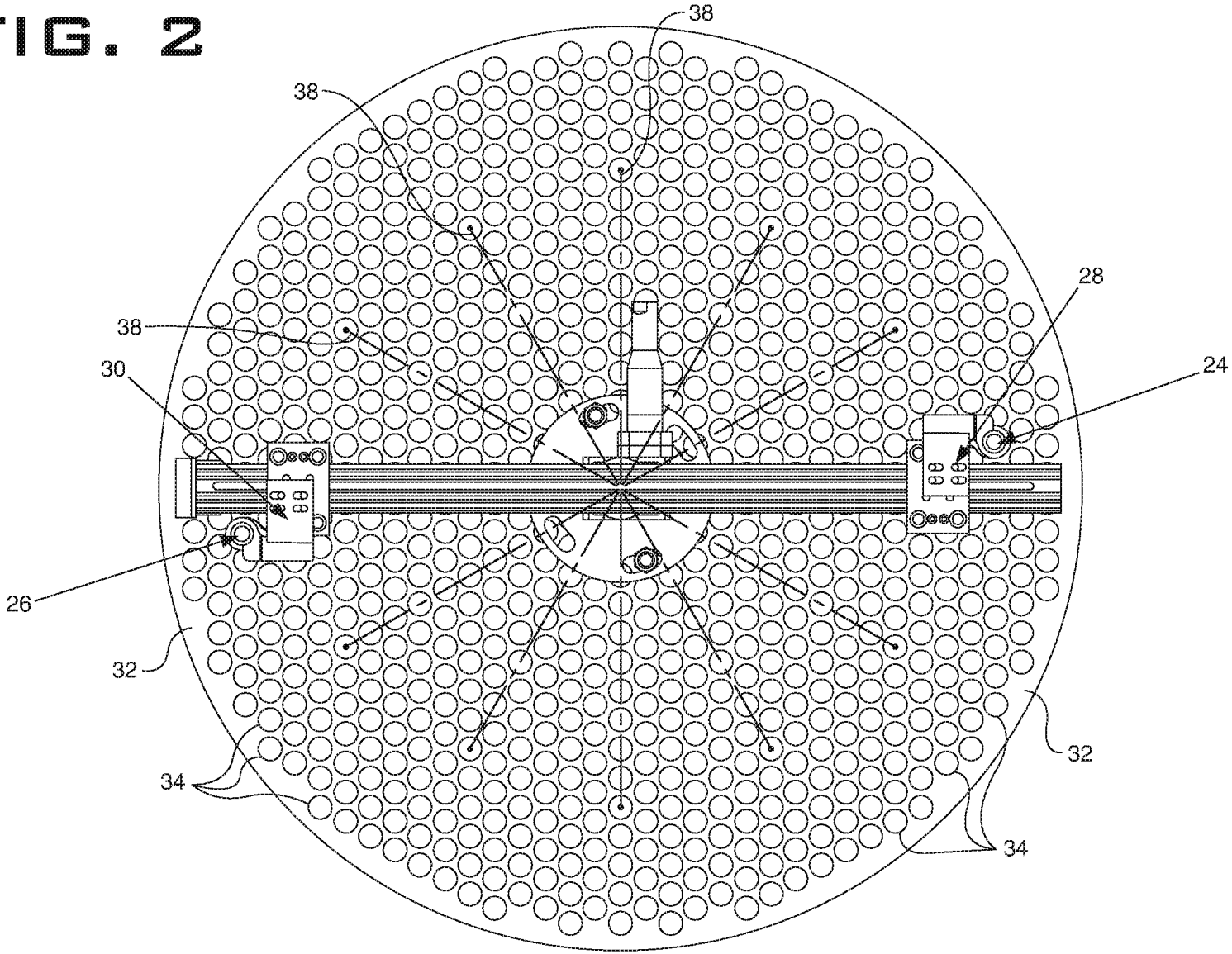
FIG. 2 (FIG. 2) is a top view of the rotary indexer apparatus attached to a circular heat exchanger plate.

As depicted in the top view of FIG. 2, support beam 18 may be rotated about vertical axis to be positioned above any one of the indexing axes 38 wherein the holes 34 are centered along an exemplary index axis 38. The rotation of support beam 18 may be directed through an eyesight based alignment of the operator, or alternatively, indexer 10 may be operatively coupled to a computer (not shown) having a non-transitory computer readable storage medium having instructions stored or encoded thereon that when executed by one or more processors performs an operation of running software configured to learn the location of holes 34 in order to automatically align support beam 18 above one of the indexing axes 38. Alternatively, the operations could include software that is pre-loaded with the location of the holes 34 such that the indexer knows where to move the carriages in order to align the first and second tubes 24, 26 with the holes 34. It should be noted that each of the indexing axes 38 intersects the vertical axis 42 perpendicularly, but each may have a different angle relative to the center when viewed from above (see FIG. 2).

After the support beam has been rotated into a position directly above an index axis 38, the second motor 22 may be activated in order to drive sprocket assembly 62 in order to rotate screw 20.

First, the second motor 22 drives a sprocket 65 within the sprocket assembly 62 to rotate about a first sprocket axis beneath the support beam 18. While the first sprocket axis is depicted as positioned below support beam 18, clearly, the assembly could be inverted and the first sprocket axis may be above support beam 18. As the first sprocket rotates, the teeth on the first sprocket move a chain in a generally 360 degree path.

A second sprocket 63 of the sprocket assembly is directly connected to an end of the threaded rod or screw 20. The second sprocket is coaxial with the longitudinal axis 21 of screw 20. The chain is wrapped around the second sprocket in a manner such that the second sprocket teeth engage the chain in a manner similar to that of the first sprocket. The movement of the second sprocket from the moving chain imparts rotational movement to the screw 20 about its longitudinal axis 21.

The rotation of screw 20 imparts linear movement to first carriage assembly 28 and second carriage assembly 30 simultaneously. As stated above, in one example the screw 20 has a first thread pattern on one side of the screw 20 and an equal pitch but opposite direction second thread pattern on the second side of the screw 20.

In one particular embodiment, the first carriage assembly 28 includes a first follower nut 72 shaped complementary to the first thread pattern and the second carriage assembly 30 includes a second follower nut 72 shaped complementary to the second thread pattern. Thus, the first and second follower nuts 72 have opposite thread patterns but similar pitches and diameters.

When screw 20 is rotated, the carriage assemblies move linearly and simultaneously relative to each other. In one embodiment, the arrangement of the threads on screw 20 may be configured in a manner such that clockwise rotation of screw 20 causes carriage assemblies 28, 30 to move linearly away from each other (i.e., away from the vertical axis/center) and that counterclockwise rotation of screw 20 causes carriage assemblies 28, 30 to move linearly towards each other (i.e., towards the vertical axis/center). Alternatively, the threads on screw 20 may be configured in a manner such that clockwise rotation of screw 20 causes carriage assemblies 28, 30 to move linearly towards each other and that counterclockwise rotation of screw 20 causes carriage assemblies 28, 30 to move away from each other.

As is shown in the side view figures, the carriage assemblies 28 and 30 are moveable between a narrow position, which is inward and close to vertical axis 42, and an outward position which is radially further away from vertical axis 42 than the narrow position. As is depicted in one of the side views, umbilical support tube 76 may be operably connected to the first guide tube 24 and the second guide tube 26. The umbilical tubes guide an ultra-high pressure hose (UHP) (not shown) therethrough. The UHP hose may be inserted through umbilical support tube 76 and through guide tube 24 or second guide tube 26. When the rotary indexer 10 is aligned directly along index axes 38, the bottom end of the first guide tube 24 is positioned directly above one of the holes 34 and the bottom end of the second guide tube 26 is positioned directly above another one of the guide holes 34.

As stated above, this step of aligning the bottom end of the respective guide tubes may be accomplished via eyesight alignment of an operator or may be controlled through computer-implemented positioning logic. This positioning logic may also be referred to generally as a "controller" so as to allow the controller to direct the first motor to rotate the support beam around the first axis 42 and align a portion of the first carriage assembly above one of the holes 34. With the bottom ends of the respective guide tubes 24, 26 positioned directly above holes 34, the UHP hose may be inserted through guide tubes 24, 26 and into and through holes 34 in order for the UHP hose to apply ultra-high pressure water into the heat exchanger. The ultra-high pressure water cleans the inside of the heat exchanger as one having ordinary skill in the art would understand. After the heat exchanger has been cleaned, the UHP hose may be removed.

Then, support beam 18 may be rotated to be positioned above another index axis 38 and another set of holes 34 that need to be cleaned. The UHP hose may continue this process of rotating beam 18 about vertical axis 42 and narrowing and widening the respective guide tubes 24, 26 carried by the respective carriage assemblies until all of the holes 34 have been cleaned.

All definitions, as defined and used herein, should be understood to control over dictionary definitions, definitions in documents incorporated by reference, and/or ordinary meanings of the defined terms.

"Logic", as used herein with respect to the computer-implemented positioning logic, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s), such as the computer-implemented positioning logic or the like, presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results.

Further, it should be appreciated that a computer associated with the one or more processors executing the computer-implemented positioning logic may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone, or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

The terms "program" or "software" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

What is claimed:

1. A cleaning device comprising:

a base adapted to be oriented parallel to an end plate of a heat exchanger or other device forming a plurality of tubes that periodically need to be cleaned, said base further being oriented at right angles to the plurality of tubes;

a cantilever support arm operatively engaged with the base and being selectively rotatable about an axis oriented parallel to the plurality of tubes, wherein said cantilever support arm extends outwardly towards a second end in a cantilevered manner relative to said axis;

at least one hose carried on the cantilever support arm and being adapted to be selectively positioned above holes formed in an end plate of the heat exchanger or other device; and a first carriage assembly operatively engaged with the cantilever support arm, said first carriage assembly being selectively linearly movable along the cantilever support arm relative to the base and in a direction perpendicular to the plurality of tubes.

2. The cleaning device of claim 1, wherein linear movement of the first carriage assembly causes a corresponding linear movement of the at least one hose.

3. The cleaning device of claim 2, further comprising a second motor for driving the first carriage assembly.

4. The cleaning device of claim 3, wherein the second motor is offset from the cantilever support arm and is configured to drive the linear movement of the first carriage assembly via a chain and sprocket assembly.

5. The cleaning device of claim 1, further comprising:

a first motor that causes the cantilever support arm to rotate.

6. The cleaning device of claim 5, further comprising:

a gear assembly interposed between the first motor and the cantilever support arm.

7. The cleaning device of claim 6, further comprising:

a slip clutch intermediate the gear assembly and the cantilever support arm, said slip clutch being adapted to slip when an overload of torque occurs.

8. The cleaning device of claim 7, wherein the slip clutch includes a sprocket sandwiched by pressure plates and a bushing extending therethrough.

9. The cleaning device of claim 7, wherein the slip clutch is a spring loaded friction style torque overload device adapted to slip in response to an overload torque in excess of a set torque level to prevent the overload of torque, and when torque load falls below the set torque level, the slip clutch stops slipping and transmits the torque.

10. The cleaning device of claim 7, wherein the slip clutch does not maintain phase between input and output.

11. A method of cleaning a heat exchanger comprising:

securing a base of a cleaning device perpendicular to a plurality of tube bores that each open in an end plate of a heat exchanger;

selectively rotating a cantilever support arm operatively engaged with the base about an axis oriented parallel to the plurality of tube bores, wherein said cantilever support arm extends outwardly towards a second end in a cantilevered manner relative to said axis;

separately aligning at least one hose carried by the arm with each of the plurality of tube bores;

delivering a high pressure fluid through the at least one hose;

operatively engaging a first carriage assembly and the cantilever support arm; and selectively moving the first carriage assembly linearly along the cantilever support arm in a plane parallel to the end plate and relative to the base.

12. The method of claim 11, further comprising:

linearly moving the at least one hose in unison with the first carriage assembly.

13. The method of claim 11, further comprising:

rotating the cantilever support arm with a first motor via a gear assembly.

14. The method of claim 13, further comprising:

positioning a slip clutch intermediate the first motor and the gear assembly; and causing the slip clutch to slip when an overload of torque occurs.

15. The method of claim 14, further comprising:

sandwiching a sprocket with pressure plates in the slip clutch; and causing a bushing to extend therethrough.

16. The method of claim 11, further comprising:

moving the first carriage assembly with a second motor.

17. The method of claim 11, further comprising:

keeping the at least one hose parallel to the plurality of tube bores as the arm rotates about the axis.

18. The method of claim 11, further comprising:

cleaning buildup from the plurality of tube bores utilizing the high pressure fluid.

19. A cleaning device comprising:

a base adapted to be oriented parallel to an end plate of a heat exchanger or other device forming a plurality of tubes that periodically need to be cleaned;

only a single cantilever support arm operatively engaged with the base and being selectively rotatable about an axis oriented parallel to the plurality of tubes using a first motor, wherein said single cantilever support arm extends outwardly towards a second end in a cantilevered manner relative to said axis; and at least one hose carried on the single cantilevered support arm and being adapted to be selectively positioned above holes formed in the end plate of the heat exchanger or other device.

20. The cleaning device of claim 19, further comprising a gear assembly interposed between the first motor and the single cantilever support arm.

* * * * *